US011579557B2

(12) United States Patent
Uchitani et al.

(10) Patent No.: US 11,579,557 B2
(45) Date of Patent: Feb. 14, 2023

(54) LUBRICANT APPLICATION DEVICE CAPABLE OF DETECTING NEAR-END AND END OF LUBRICANT

(71) Applicant: Hewlett-Packard Development Company, L.P., Spring, TX (US)

(72) Inventors: Takeshi Uchitani, Yokohama (JP); Katsushi Higashida, Yokohama (JP); Takayuki Wakai, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/414,044

(22) PCT Filed: Aug. 13, 2020

(86) PCT No.: PCT/US2020/046162
§ 371 (c)(1),
(2) Date: Jun. 15, 2021

(87) PCT Pub. No.: WO2021/041045
PCT Pub. Date: Mar. 4, 2021

(65) Prior Publication Data

US 2022/0179352 A1 Jun. 9, 2022

(30) Foreign Application Priority Data

Aug. 29, 2019 (JP) ..... JP2019-156817

(51) Int. Cl.
*G03G 21/00* (2006.01)

(52) U.S. Cl.
CPC ..... *G03G 21/0094* (2013.01)

(58) Field of Classification Search
CPC . G03G 21/0094; G03G 21/007; G03G 15/161
USPC ..... 399/346
See application file for complete search history.

(56) References Cited

U.S. PATENT DOCUMENTS

| | | | | |
|---|---|---|---|---|
| 9,063,500 | B2 | 6/2015 | Gotoh et al. | |
| 2007/0183824 | A1 | 8/2007 | Suda et al. | |
| 2011/0229232 | A1* | 9/2011 | Kojima | G03G 21/0094 399/346 |

(Continued)

FOREIGN PATENT DOCUMENTS

| | | | |
|---|---|---|---|
| JP | 2014029403 | A | 7/2012 |
| JP | 2014029408 | A | 7/2012 |
| JP | 2016102997 | A | 5/2015 |

(Continued)

*Primary Examiner* — Jessica L Eley
(74) *Attorney, Agent, or Firm* — Foley & Lardner LLP

(57) ABSTRACT

An example lubricant application device includes a rotatable applicator to apply a lubricant from a solid lubricant source to a rotating member, a support member to support the solid lubricant source in contact with the rotatable applicator, a near-end detection member and an end detection member coupled to the support member. The near-end detection member is coupled to the support member such that it comes in contact with the rotatable applicator after a first amount of the solid lubricant source has been consumed. The end detection member is coupled to the support member such that it comes in contact with the rotatable applicator after a second amount of the solid lubricant source has been consumed.

16 Claims, 21 Drawing Sheets

(56) References Cited

U.S. PATENT DOCUMENTS

2015/0160600 A1* 6/2015 Saito ..... G03G 15/757
399/346

FOREIGN PATENT DOCUMENTS

| | | | |
|---|---|---|---|
| JP | 2017181880 | A | 3/2016 |
| JP | 2017015979 | A | 1/2017 |
| JP | 2017111419 | A | 6/2017 |
| JP | 2017138404 | A | 8/2017 |

* cited by examiner

LUBRICANT APPLICATION DEVICE CAPABLE OF DETECTING NEAR-END AND END OF LUBRICANT

BACKGROUND

An image forming apparatus of electrophotography may be operated to adhere toner to an image carrier having a latent image formed thereon, to transfer the toner to paper, and to fix the transferred toner onto the paper. The image carrier corresponds to a photosensitive drum and an intermediate transfer belt. A lubricant is applied on a surface of the image carrier in order to protect the image carrier and reduce friction. A device for the application of this lubricant may be referred to as a lubricant application device. When the lubricant is consumed and the lubricant application device is empty (the lubricant is exhausted), the lubricant application device or a unit containing the lubricant application device is replaced.

DETAILED DESCRIPTION

Figure 1:
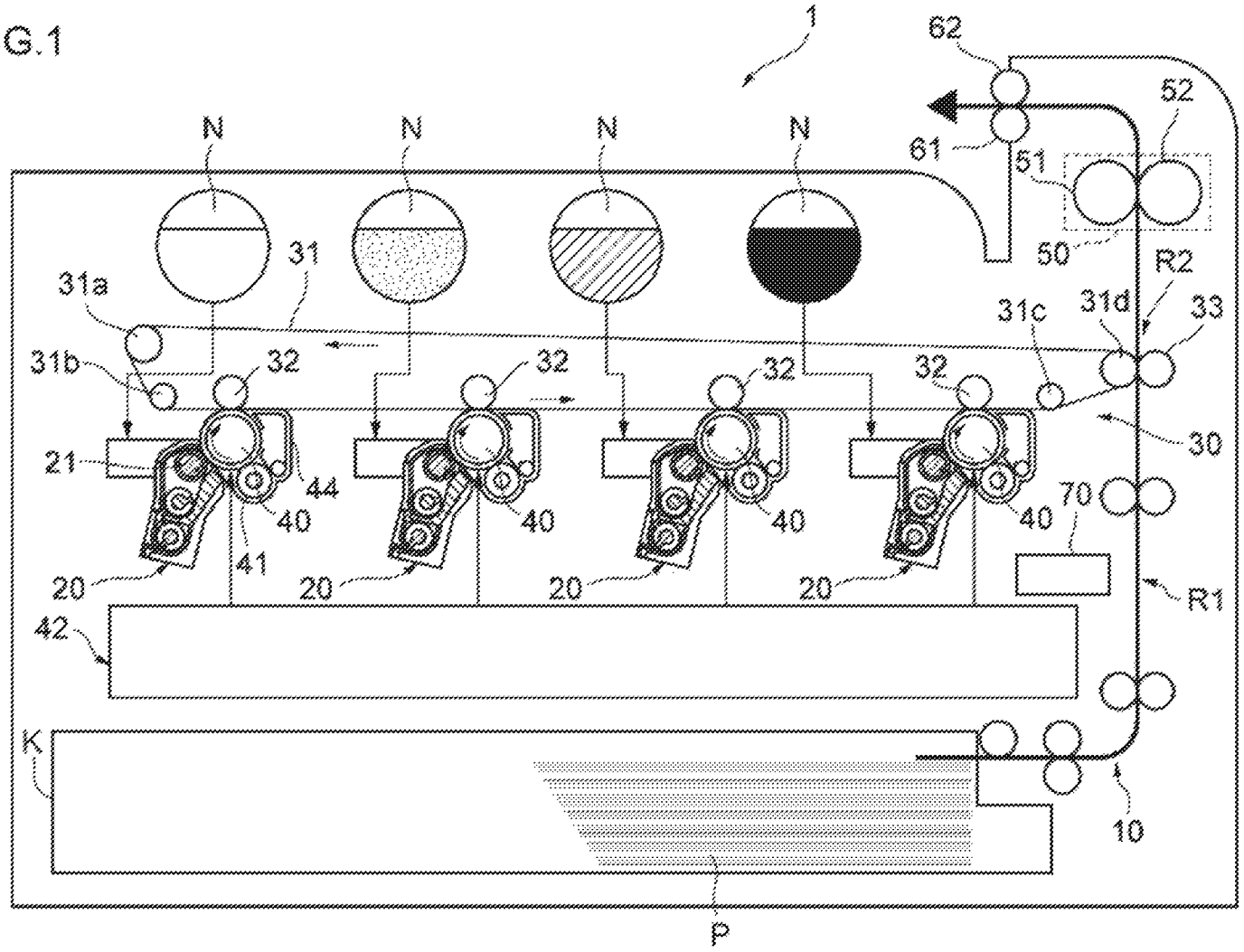
FIG. 1 is a schematic diagram of an example image forming apparatus.

In the following description, with reference to the drawings, the same reference numbers are assigned to the same components or to similar components having the same function, and overlapping description is omitted. The drawings may not illustrate all feature elements to scale, and some features or components may be partially emphasized in some drawings for ease of description of the operations and effects of the present disclosure.

An example lubricant application device may include a rotatable applicator to apply a lubricant from a solid lubricant source (or solid lubricant) to a rotating member, a support member to support the solid lubricant source to be in contact with the rotatable applicator, a near-end detection member coupled to the support member, and an end detection member coupled to the support member. The near-end detection member is coupled to the support member such that it comes in contact with the rotatable applicator after consumption of a first amount of the solid lubricant source. The end detection member is coupled to the support member such that it comes in contact with the rotatable applicator after consumption of a second amount of the solid lubricant source. The example lubricant application device of this type can detect a near-end or an end of the lubricant, optimize or improve a replacement timing of the lubricant, of the lubricant application device or of a unit including the lubricant application device.

In some examples, the near-end detection member is configured to increase the torque of a motor driving the rotatable applicator when it comes in contact with the rotatable applicator, and is released from contact with the rotatable applicator after the torque is increased. A lubricant application device of this type can detect a near-end or the like of the lubricant in a lower-cost and space-saving manner.

In some examples, the end detection member is configured to increase the torque of the motor when it comes in contact with the rotatable applicator. In addition, a release from contact with the rotatable applicator is achieved by reverse-rotating the rotatable applicator. Further, the motor has torque detection means (e.g., a motor torque detector). A lubricant application device of this type can more precisely detect the near-end and the end of the lubricant, and replacement can be made in a state where the lubricant is almost exhausted (used up).

In some examples, the near-end detection member includes a base portion, an extended portion extending from the base portion toward the applicator, an upper end surface formed on the base portion and the extended portion, and an engagement member protruding from the upper end surface. At a position where the near-end detection member comes in contact with the rotatable applicator, the upper end surface abuts with a lower end portion of the support member, and the engagement member engages with an overhang portion extending from the lower end portion of the support member. The engagement of the engagement member with the overhang portion is released by reverse-rotating the rotatable applicator, to release the near-end detection member from contact with the rotatable applicator. A lubricant application device of this type can detect the near-end or the like of the lubricant in a lower-cost and space-saving manner.

In some examples, the base portion of the near-end detection member is provided with a side portion having a pivot point (or pivot) rotatably supported by the support member. When the engagement is released, the near-end detection member rotates about the pivot point such that the extended portion of the near-end detection member is moved to a position where it does not contact the rotatable applicator. In addition, the end detection member is part of the support member. A lubricant application device of this type can detect the near-end and the end of the lubricant in a lower-cost and space-saving manner.

An example image forming apparatus may include a lubricant application device. The example lubricant application device may include a rotatable applicator to apply a lubricant from a solid lubricant source (or solid lubricant) to a photosensitive drum, a support member to support the solid lubricant source in contact with the rotatable applicator, a near-end detection member coupled to the support member, and an end detection member coupled to the support member. The near-end detection member is coupled to the support member such that it comes in contact with the rotatable applicator after consumption of a first amount of the solid lubricant source. The end detection member is coupled to the support member such that it comes in contact with the rotatable applicator after consumption of a second amount of the solid lubricant source. An image forming apparatus of this type can detect a near-end and an end of the lubricant, to optimize the replacement timing of the lubricant, of the lubricant application device or of a unit including the lubricant application device.

In some examples, the near-end detection member is configured to increase the torque of a motor driving the rotatable applicator when it comes in contact with the rotatable applicator, and is released from contact with the rotatable applicator after the torque is increased. The end detection member is configured to increase the torque of the motor when it comes in contact with the rotatable applicator. An image forming apparatus of this type can detect the end and the near-end of the lubricant in a low-cost and space-saving manner.

An example image forming apparatus may include a controller. The controller may be adapted to monitor the torque of the motor, to detect a near-end of the solid lubricant source when the near-end detection member comes in contact with the rotatable applicator to increase the torque of the motor, and to detect an end of the solid lubricant source when the end detection member comes in contact with the rotatable applicator to increase the torque of the motor, in order to more precisely detect the near-end and the end of the lubricant.

The detecting of the near-end and/or the end of the lubricant may include observing or detecting a distance by which a surface of the photosensitive drum has moved or changed, and determining that the lubricant is in a near-end state or in an end state based on a comparison of the distance with a predetermined value, or with a threshold value. For example, when the distance exceeds a predetermined value, it is judged or determined that the lubricant is near an end (in a near-end state) and/or ended (in a end state). In addition, a rapid increase in the torque of the motor indicates that the detection is erroneous. The example image forming apparatus of this type can enhance the accuracy in detecting a near-end and an end of the lubricant.

With reference to FIG. 1, an example image forming apparatus 1 will be described. The image forming apparatus 1 may form a color image by use of colors such as magenta, yellow, cyan and black. The image forming apparatus 1 can have a recording medium conveyance unit (or recording medium conveyance device) 10 for conveying a recording medium such as paper (or paper sheet) P, developing devices 20 for developing an electrostatic latent image, a transfer unit (or transfer device) 30 for secondary transfer of a toner image on the paper P, photosensitive drums 40 as electrostatic latent image carriers to form an image on a circumferential surface thereof, and a fixing unit (or fixing device) 50 for fixing the toner image on the paper P.

The recording medium conveyance unit 10 can convey the paper P as a recording medium on which an image is to be formed, on a conveyance path R1. The paper P can be stacked and accommodated in a cassette K. The recording medium conveyance unit 10 can allow the paper P to arrive at a secondary transfer region R2 through the conveyance path R1 at the timing when a toner image to be transferred to the paper P arrives at the secondary transfer region R2.

One developing device 20 is provided for each color, and accordingly, the image forming apparatus 1 may include four developing devices 20 associated with the four colors. Each developing device 20 can have a developing roller 21 to allow toner to be carried on a photosensitive drum 40. The developing device 20 mixes toner (e.g., toner particles) and carrier (e.g., carrier particles) to obtain a developer. The developing device 20 adjusts a mixing ratio of the toner and the carrier to a predetermined or targeted ratio; and mixes and stirs to toner with the carrier, to disperse the toner uniformly in the developer, to impart the developer with an optimal charge amount. This developer is transferred to and carried on the developing roller 21. When the rotation of the developing roller 21 conveys the developer to a region facing the photosensitive drum 40, the toner in the developer carried on the developing roller 21 is moved or transferred onto the electrostatic latent image formed on the circumferential surface of the photosensitive drum 40, so as to develop the electrostatic latent image, into a toner image.

The transfer unit 30 can convey the toner image formed by the developing device 20 to the secondary transfer region R2 where the toner image is to be secondarily transferred to the paper P. The transfer unit 30 can include a transfer belt 31, support rollers 31*a*, 31*b*, 31*c* and 31*d* supporting the transfer belt 31, a primary transfer roller 32 holding the transfer belt 31 together with the photosensitive drum 40, and a secondary transfer roller 33 holding the transfer belt 31 together with the support roller 31*d*.

The transfer belt 31 can be an endless belt, which is circularly moved by support rollers 31*a*, 31*b*, 31*c* and 31*d*. The primary transfer roller 32 can be provided so as to press or engage the photosensitive drum 40 from an inner side (e.g., an inner circumference) of the transfer belt 31. The secondary transfer roller 33 can be provided so as to press against the support roller 31*d* from an outer side (e.g., an outer circumference) of the transfer belt 31.

One photosensitive drum 40 is provided for each color, and accordingly, the image forming apparatus 1 may include four photosensitive drums 40 associated with the four colors. The photosensitive drums 40 may be spaced apart along a moving direction of the transfer belt 31. The developing device 20, a charging roller 41, an exposure unit (or exposure device) 42, a cleaning unit (or cleaning device) 43, and the like can be provided about each of the photosensitive drums 40, for example about the circumference of the photosensitive drum 40.

The charging roller 41 may include charging means (e.g., a charging device) that uniformly charges the surface of the photosensitive drum 40 at a predetermined electric potential. The charging roller 41 can rotate as it follows the rotation of the photosensitive drum 40. The exposure unit 42 can direct light to the surface of the photosensitive drum 40, which has been charged by the charging roller 41, in accordance with the image to be formed on the paper P. This changes the electric potential of a portion, which has been exposed by the exposure unit 42, of the surface of the photosensitive drum 40, in order to form an electrostatic latent image. Toner tanks N are filled with magenta, yellow, cyan and black toners, respectively, and are positioned to face the respective developing devices 20. Each of the four developing devices 20 develops an electrostatic latent image formed on the associated photosensitive drum 40 with toner supplied from a corresponding one of the toner tanks N that faces the developing device 20, so that a toner image is generated. The cleaning unit 44 collects toner remaining on the photosensitive drum 40 after the toner image formed on the photosensitive drum 40 is primarily transferred to the transfer belt 31. In one example, the photosensitive drum 40 and the charging roller 41 are attached to a housing, which forms a cleaning unit 44. For example, the cleaning unit 44, the photosensitive drum 40 and the charging roller 41 are unitized.

The fixing unit 50 can adhere and fix to the paper P, the toner image, which has been secondarily transferred from the transfer belt 31 to the paper P. The fixing unit 50 can have a heating roller 51 for heating the paper P and a pressing roller 52 for pressing the heating roller 51. The heating roller 51 and the pressing roller 52 are formed in a cylindrical shape, and the heating roller 51 can have a heat source such as a halogen lamp therein. A fixing nip portion as a contact region is formed between the heating roller 51 and the pressing roller 52, and the paper P may be passed through the fixing nip portion to melt and fix the toner image onto the paper P.

In addition, the image forming apparatus 1 can be provided with discharge rollers 61, 62 for discharging, to the outside of the apparatus, the paper P having the toner image fixed thereon.

Example printing operations of the example image forming apparatus 1 are described. When an image signal of an image to be recorded on a recording medium is input into the image forming apparatus 1, a controller 70 of the image forming apparatus 1 allows the charging roller 41 to uniformly charge the surface of the photosensitive drum 40 at a predetermined electric potential based on the received image signal (charging process). Thereafter, the exposure unit 42 applies or directs laser light to the surface of the photosensitive drum 40 to form an electrostatic latent image (exposure process).

In the developing device 20, the electrostatic latent image is developed, to form a toner image (developing process). Each of the formed toner image is primarily transferred from the photosensitive drum 40 to the transfer belt 31 in a region where the photosensitive drum 40 faces the transfer belt 31 (transfer process). Toner images formed on the four photosensitive drums 40 are sequentially layered on the transfer belt 31, so that a single composite toner image can be formed. Then, the composite toner image can be secondarily transferred to the paper P conveyed from the recording medium conveyance unit 10 in the secondary transfer region R2 where the support roller 31*d* faces the secondary transfer roller 33.

The paper P having the composite toner image secondarily transferred thereon can be conveyed to the fixing unit 50. The paper P is passed between the heating roller 51 and the pressing roller 52 to apply heat and pressure to the paper; and accordingly, the composite toner image is melted and fixed onto the paper P (fixing process). Thereafter, the paper P can be discharged by the discharge rollers 61, 62 to the outside of the image forming apparatus 1.

The above-described operations of the image forming apparatus 1 can be controlled by the controller 70. The controller 70 can be implemented in the form of machine-readable data (e.g., processor-readable data and instructions), which is executable by a processor such as a central processing unit. The machine-readable instruction can be stored on a computer readable medium.

Figure 2:
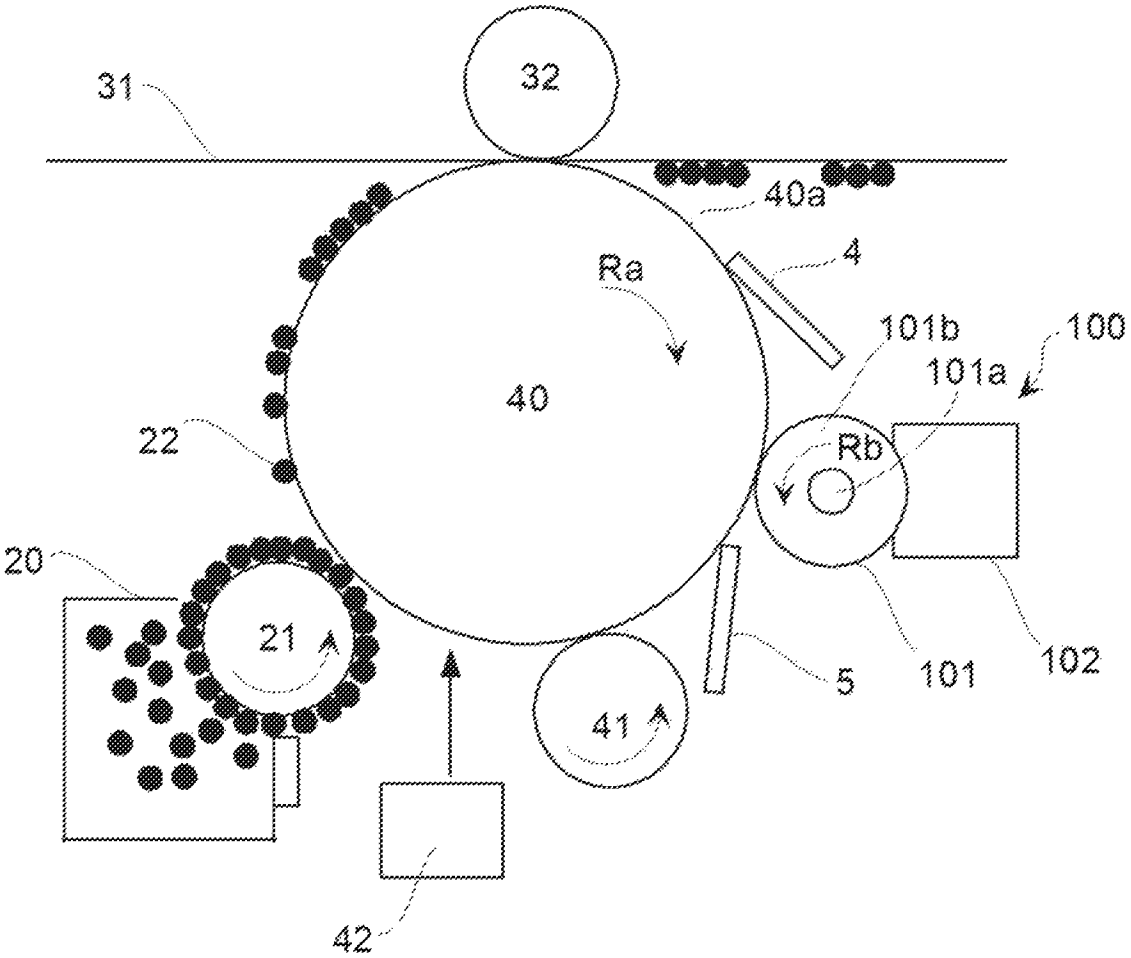
FIG. 2 is a schematic diagram illustrating a cross-section of a photosensitive drum and components adjacent thereto in an image forming apparatus according to an example.

FIG. 2 is a cross-sectional view schematically showing the vicinity of the photosensitive drum (also referred to as an image carrier or a rotatable member) 40 in the example image forming apparatus 1 shown in FIG. 1. FIG. 2 shows an operation state where a toner image is formed on the transfer belt 31, with toner 22.

With reference to FIG. 2, an example image forming apparatus 1 includes, in sequence along a rotational direction Ra of the photosensitive drum 40, a primary transfer roller 32, a cleaning blade 4, a lubricant application device 100, a blade 5, a charging roller 41, an exposure unit (or exposure device) 42, a developing device 20 and others. The charging roller 41, the exposure unit 42 and the developing device 20 are described above.

The cleaning blade 4 can be part of the cleaning unit 44, and it can collect toner remaining on the photosensitive drum 40 (e.g., residual toner after transfer to the transfer belt 31) even after a toner image is primarily transferred to an intermediate transfer body (for example, transfer belt 31) from the photosensitive drum 40. The cleaning blade 4 can be formed of an elastic body such as urethane rubber. The cleaning blade 4 is configured so as to be pressed against the surface of the photosensitive drum 40 to scrape the residual toner after transfer on the surface of the photosensitive drum 40.

An example lubricant application device 100 can apply a lubricant onto a surface of an image carrier to protect the image carrier (for example, photosensitive drum 40) and reduce friction (to a lower level). The lubricant application device 100 includes a feeding roller (also referred to as an applicator) 101 provided on the circumference of the photosensitive drum 40, and a solid lubricant source (or solid lubricant) 102. The feeding roller 101 is positioned between the cleaning blade 4 and the blade 5 about the circumference of the photosensitive drum.

The blade 5 can be provided so as to uniformly layer fine particles of the lubricant applied on the surface of the photosensitive drum 40. The blade 5 can be formed of an elastic body such as urethane rubber. The blade 5 is configured to be pressed against the surface of the photosensitive drum 40. In some examples, the blade 5 can serve as a cleaning blade, and in this case, the cleaning blade 4 can be omitted.

The lubricant source 102 can be provided so as to be in contact with the feeding roller 101. Contact of the lubricant source 102 with an elastic body 101*b* (described below) of the feeding roller 101 allows the feeding roller 101 to carry the lubricant. In particular, the lubricant source 102 can be urged by an urging member so as to be pressed against the feeding roller 101. This enables the elastic body 101*b* of the feeding roller 101 to scrape the lubricant and carry fine particles of the lubricant thereon. Then, the feeding roller 101 can apply the carried fine particles of the lubricant onto the surface 40*a* of the photosensitive drum 40.

The solid applicant source 102 can be a molded body, for example, by molding a lubricant into a predetermined shape (bar-like, square pillar or cylindrical shape). The lubricant source 102 can include, for example, zinc stearate, barium stearate, lead stearate and/or the like.

The feeding roller 101 has a rotatable axial portion 101*a* and an elastic body 101*b* formed on a circumferential surface of the axial portion 101*a*. The axial portion 101*a* extends longitudinally and has two opposite ends that can be rotatably supported by bearing members, and can be rotated and driven by a driving device. The feeding roller 101 is driven so as to rotate in a rotational direction Rb that follows the rotation of the photosensitive drum 40. The elastic body 101*b* can be formed of foam (foam layer) for example. For example, the elastic body 101*b* can include a sponge-like elastic body. The foam can be, for example, urethane foam. In addition, the elastic body 101*b* can be formed of a raised fiber, for example, instead of foam. For example, the elastic body 101*b* is a brush-like elastic body. The raised fiber can have flexibility, and can be, for example, a polyolefin-based resin (for example, polyethylene or polypropylene). In some examples, the lubricant application device 100 can be replaceably provided as a single body in the image forming apparatus 1. In another example, the feeding roller 101, the lubricant source 102 and the blade 5 can be attached to a housing, which forms the cleaning unit 44.

In the lubricant application device 100, the solid lubricant source 102 is consumed (or dispensed) by a rotational operation of the feeding roller 101, and finally, the solid lubricant source 102 becomes empty or ended (or exhausted). When the solid lubricant source 102 is exhausted (becomes ended), the lubricant source 102 or the lubricant application device 100, or the unit including the lubricant application device 100 is to be replaced by a service technician or the like. The example image forming apparatus 1 performs detection of a remaining amount of the solid lubricant source. For example, based on the distance by which a surface of the feeding roller 101 has moved (travel distance), a consumed amount of the lubricant source can be predicted. This prediction may vary based on environmental conditions, etc.

Figure 3:
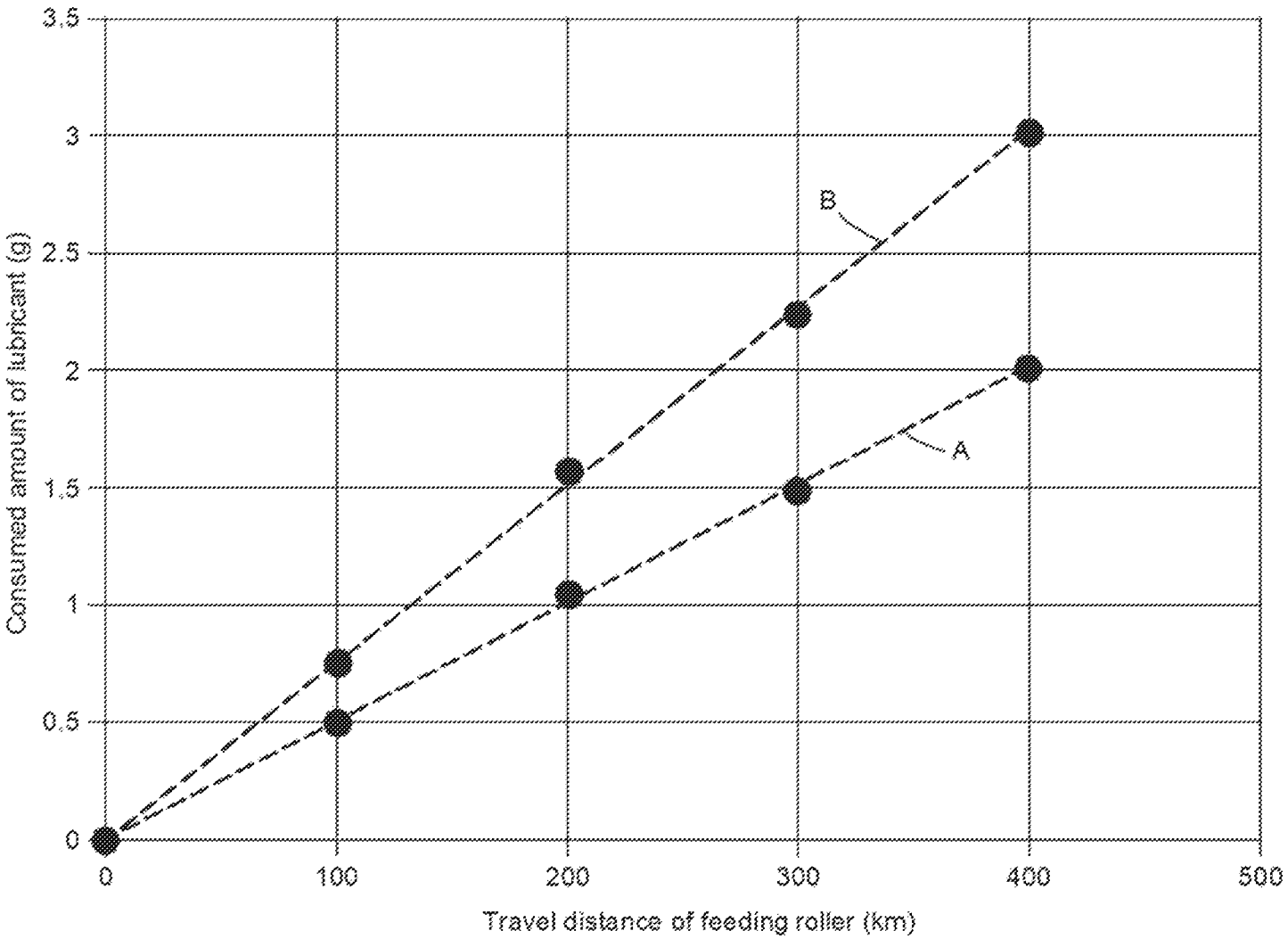
FIG. 3 is a graph of a consumed amount of lubricant relative to a travel distance of a feeding roller, according to an example.

FIG. 3 shows a relationship between consumed amounts of the lubricant and travel distances of the feeding roller, where the curve identified as A represents a case in a room temperature environment and the curve identified as B represents a case in a low-temperature and low-humidity environment. Based on the graph of FIG. 3, the consumed amount of the lubricant is changed depending on the environmental condition. For example, in FIG. 3, the consumed amount of the lubricant in the low-temperature and low-humidity environment is about 1.5 times relative to that in the room temperature environment. Accordingly, the determination of the near-end (near-end state) and of the end (end state) of the lubricant based on the travel distance of the feeding roller 101 may vary substantially. The example image forming apparatus 1 detects a near-end state of the lubricant, so that the lubricant may be replaced in a state where the lubricant is almost used to the very end (before the lubricant is entirely exhausted).

With reference to FIG. 4, an example lubricant application device 100' includes a rotatable feeding roller (also referred to as an applicator) 101 that applies a lubricant from a solid lubricant source (or solid lubricant) 102 to a photosensitive drum (also referred to as a rotating member) 40, a support member 103 that supports the solid lubricant source 102 to be in contact with the rotatable feeding roller 101, a near-end detection member 110 coupled to the support member 103, and an end detection member 130 coupled to the support member 103. The near-end detection member 110 is coupled to the support member 103 such that it comes in contact with the rotatable feeding roller 101 after consumption of a first amount of the solid lubricant source 102. The end detection member 130 is coupled to the support member 103 such that it comes in contact with the rotatable feeding roller 101 after consumption of a second amount of the solid lubricant source 102.

Figure 4A:
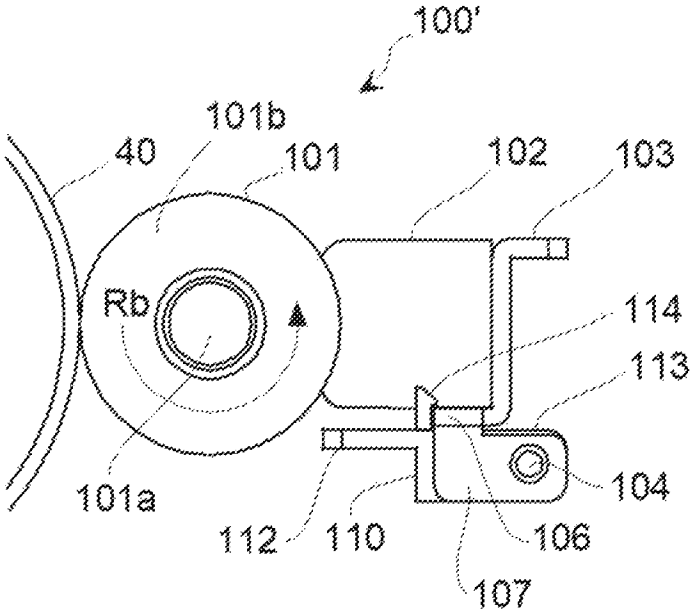
FIG. 4A is a schematic diagram, illustrating a side view of a lubricant application device and adjacent components according to an example, where the lubricant is in an initial state.
Figure 4B:
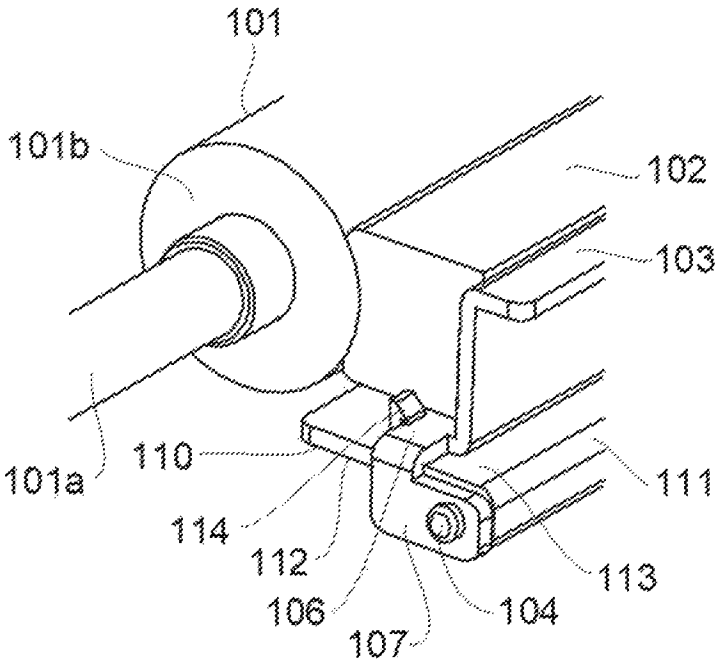
FIG. 4B is a schematic diagram illustrating a perspective view of the lubricant application device of FIG. 4A.
Figure 5A:
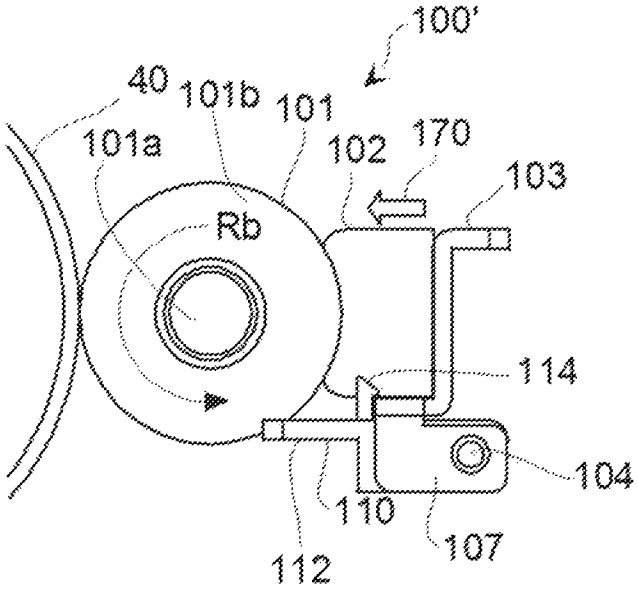
FIG. 5A is a schematic diagram, illustrating a side view of the lubricant application device and the adjacent components of FIG. 4A, shown in an operational state where a near-end state of the lubricant is detected.
Figure 5B:
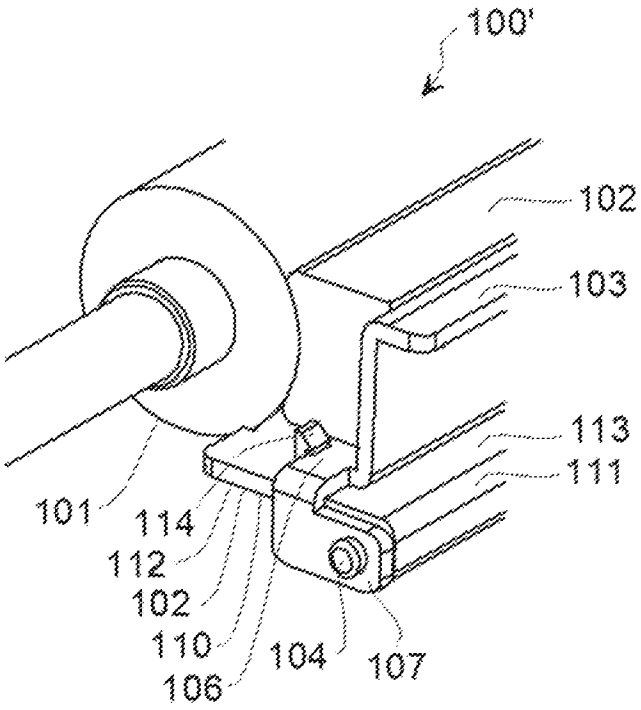
FIG. 5B is a schematic diagram, illustrating a perspective view of the lubricant application device of FIG. 5A.
Figure 6A:
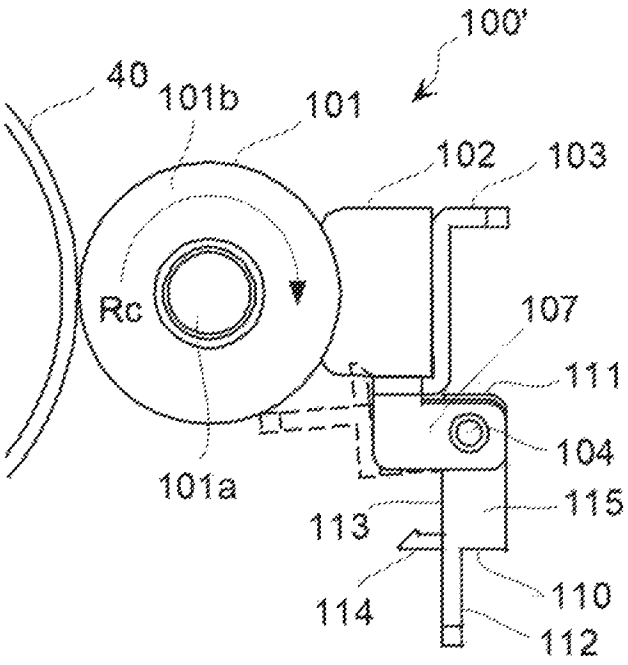
FIG. 6A is a schematic diagram, illustrating a side view of the lubricant application device and of the adjacent components of FIG. 5A, shown in an operational state after the near-end state of the lubricant has been detected.
Figure 6B:
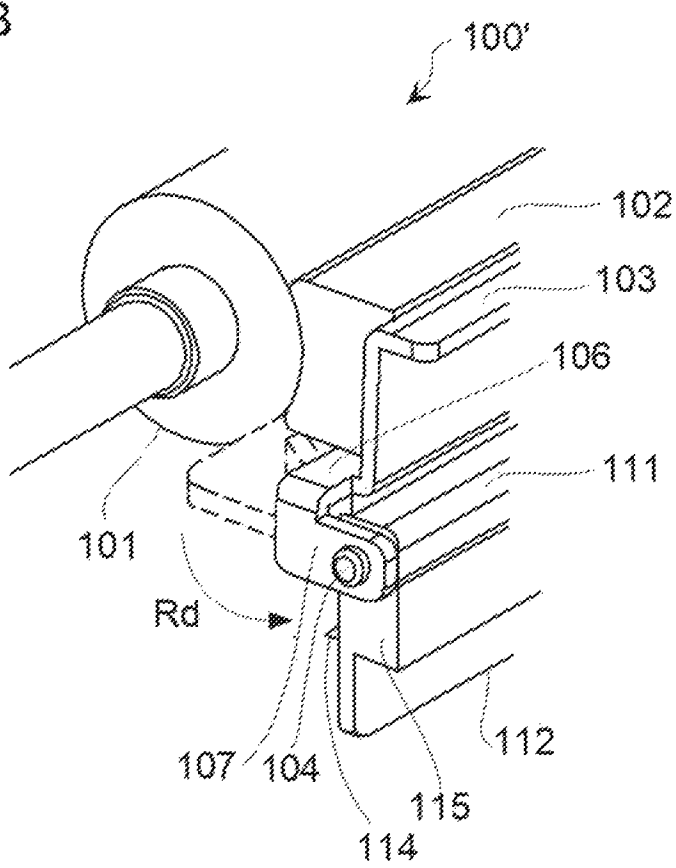
FIG. 6B is a schematic diagram, illustrating a perspective view of the lubricant application device of FIG. 6A.

FIG. 4A to FIG. 6B show the example lubricant application device 100' arranged to apply a lubricant to the photosensitive drum 40. FIGS. 4A and 4B show an initial state of the lubricant source 102. FIGS. 5A and 5B show a state wherein the near-end is detected by contact of the near-end detection member 110 with the feeding roller 101 after consumption of a first amount of the solid lubricant source 102 (e.g., a near-end state of the lubricant source 102). FIGS. 6A and 6B show that after detection of the near-end, reverse-rotation of the feeding roller 101 rotates the near-end detection member 110 about a pivot point (or pivot) 104 to move away the near-end detection member 110 from the feeding roller 101 (non-contact state with the feeding roller 101).

In some examples, the feeding roller 101 of the lubricant application device 100' can be rotated and driven via a driving unit to transmit power from a motor to rotate and drive the photosensitive drum 40. A motor to rotate and drive the photosensitive drum 40 has torque detection means (e.g., a torque detector, or a motor torque detector). For example, such a motor can be 42M series of an outer rotor brushless DC motor manufactured by Nidec (NIDEC CORPORATION), In some examples, the feeding roller 101 may be rotated and driven by a separate motor having torque detection means (e.g., a motor torque detector). The motor is controlled by the controller 70 of the image forming apparatus 1, and the controller 70 can monitor torque information from torque detection means (motor torque detector) of such a motor.

Figure 7A:
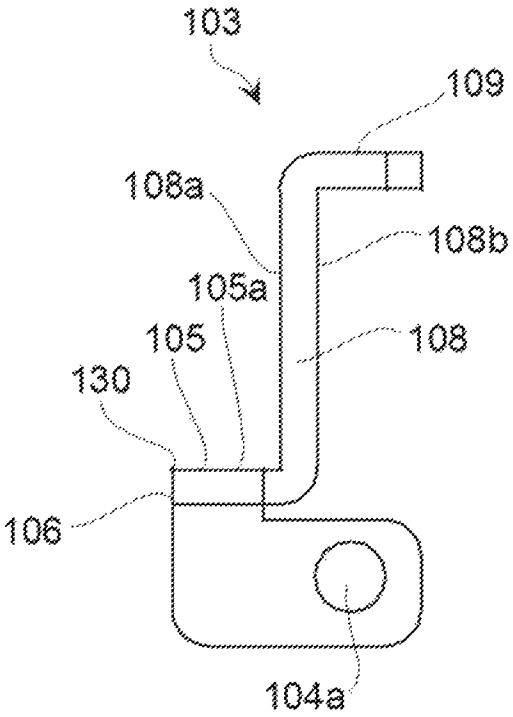
FIG. 7A is a side view of a support member of an example lubricant application device.
Figure 7B:
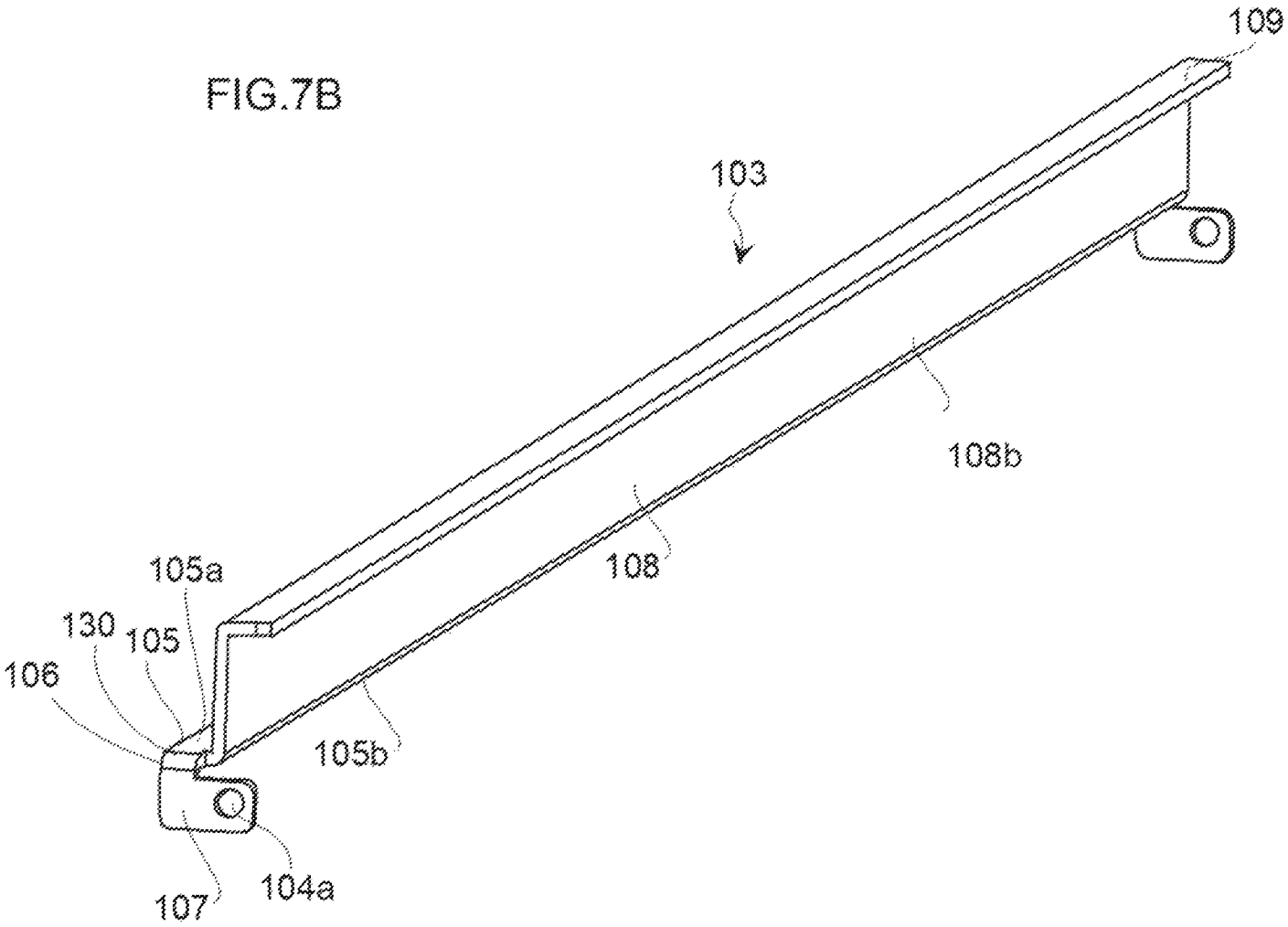
FIG. 7B is a perspective view of the example support member illustrated in FIG. 7A.

FIG. 7A is a side view schematically showing the support member 103 of the example lubricant application device 100'. FIG. 7B is a perspective view schematically showing the support member 103. The support member 103 has a base plate 108, an upper end portion 109 vertically extending from a bottom surface 108*b* of the base plate 108 in an upper portion of the base plate 108, and a lower end portion 105 vertically extending from the upper surface 108*a* of the base plate 108 in a lower portion of the base plate 108. In some examples, the solid lubricant source 102 can be carried on an upper surface 105*a* of the lower end portion 105 of the support member 103, and can be fixed to the upper surface 108*a* of the base plate 108 by use of a double-sided adhesive tape or the like. The support member 103 can be of a metal such as stainless steel. The support member 103 can be urged by urging means (e.g., an urging device such as a spring, for example) so as to press the solid lubricant source 102 against the feeding roller 101. The support member 103 has an overhang portion (or a ledge portion) 106 extending from the lower end portion 105 in a longitudinal direction of the base plate 108. The support member 103 has a side end portion 107 extending from an end portion of the overhang portion 106 in a vertical direction of the bottom surface 105*b* of the lower end portion 105 and extending in a vertical direction of the bottom surface 108*b* of the base plate. The side end portion 107 has an opening 104*a* to rotatably support the near-end detection member 110. The lower end portion 105 of the support member 103 can be configured to also serve as the end detection member 130 to detect an end of the lubricant source 102. The end detection will be described.

Figure 8A:
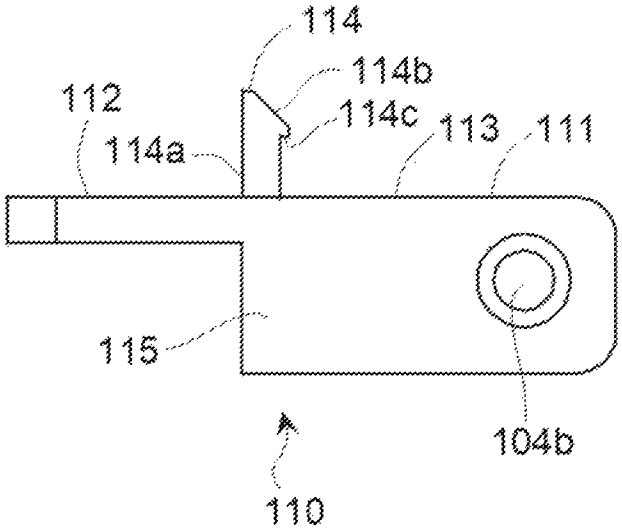
FIG. 8A is a schematic side view of a near-end detection member of an example lubricant application device.
Figure 8B:
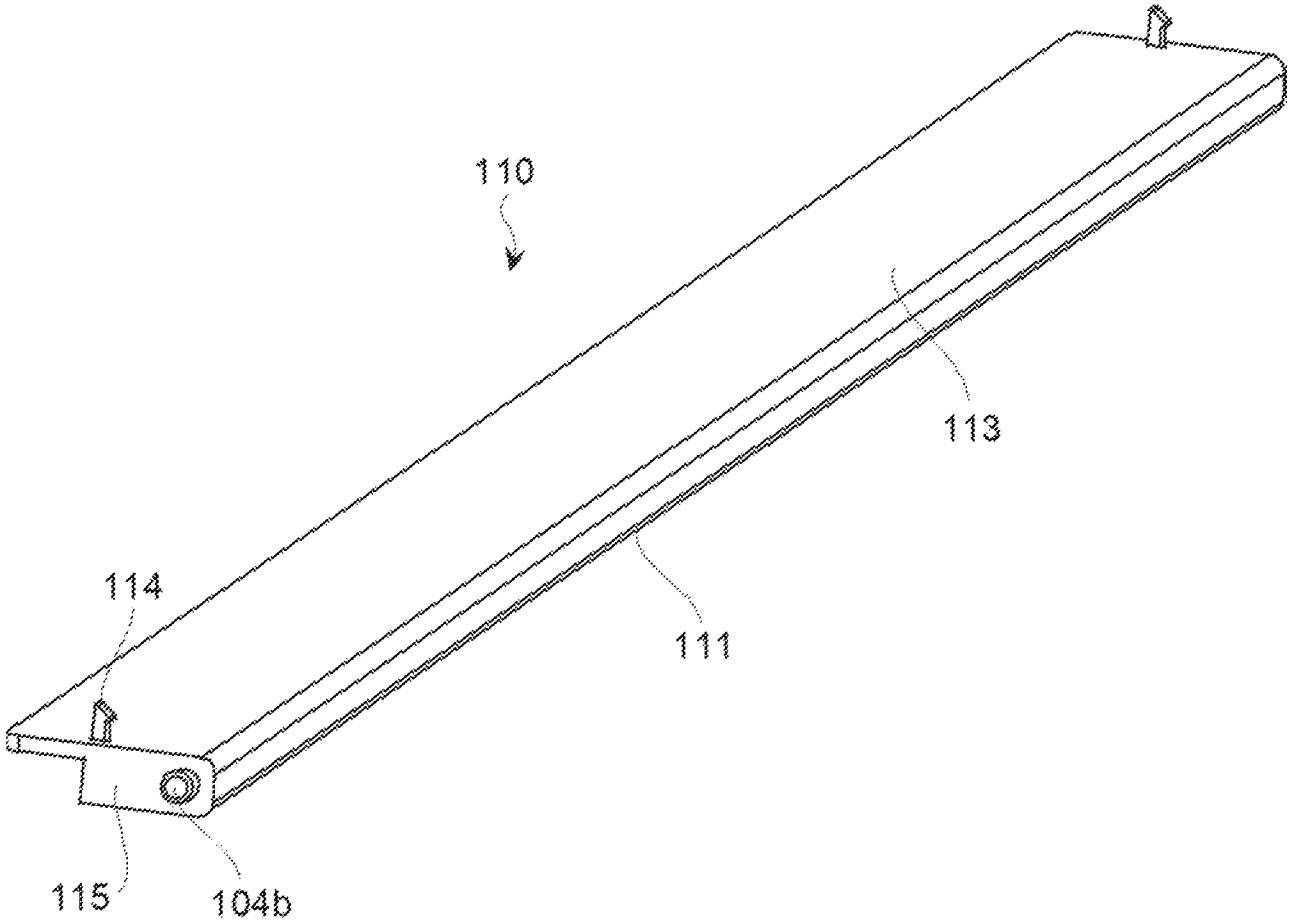
FIG. 8B is a schematic perspective view of the near-end detection member illustrated in FIG. 8A.

FIG. 8A is a side view schematically showing the near-end detection member 110 of the lubricant application device 100'. FIG. 8B is a perspective view schematically showing the near-end detection member 110. The near-end detection member 110 can be formed of, for example, a resin (for example, ABS resin). The near-end detection member 110 has a base portion 111 and an extended portion 112 vertically extending in a longitudinal direction of the base portion 111. An upper end surface 113 of the near-end detection member 110 includes the base portion 111 and the extended portion 112. An engagement member 114 for snap-fit or engagement with the overhang portion 106 of the support member 103 protrudes from the upper end surface 113. The engagement member 114 has an axial portion 114*a* and a projected engagement portion 114*b*. The axial portion 114*a* can have a width of about 1 mm to about 2 mm, for example about 1.5 mm. The axial portion 114*a* can have a thickness of about 0.5 mm to about 1.5 mm, for example about 0.8 mm. In addition, the projected engagement portion 114*b* has a portion in contact and engagement with the overhang portion 106, and the portion can have a width of about 0.2 mm to about 0.4 mm, for example about 0.3 mm. The engagement member 114 may be configured such that a minimum load for releasing the projected engagement portion 114*b* from contact with the overhang portion 106 of the support member 103 is 1 N (102 gf).

The base portion 111 of the near-end detection member 110 has a side portion 115 having a projection 104*b*. In some examples, the projection 104*b* is configured to be in snap engagement with the opening 104*a* provided on the side end portion 107 of the support member 103 such that the near-end detection member 110 is rotatably supported by the support member 103. In some examples, instead of the snap engagement, the projection 104*b* may be configured so as to be fixed by forming a groove in an axial portion of the projection 104*a* and loading a snap ring on the groove.

Figure 10:
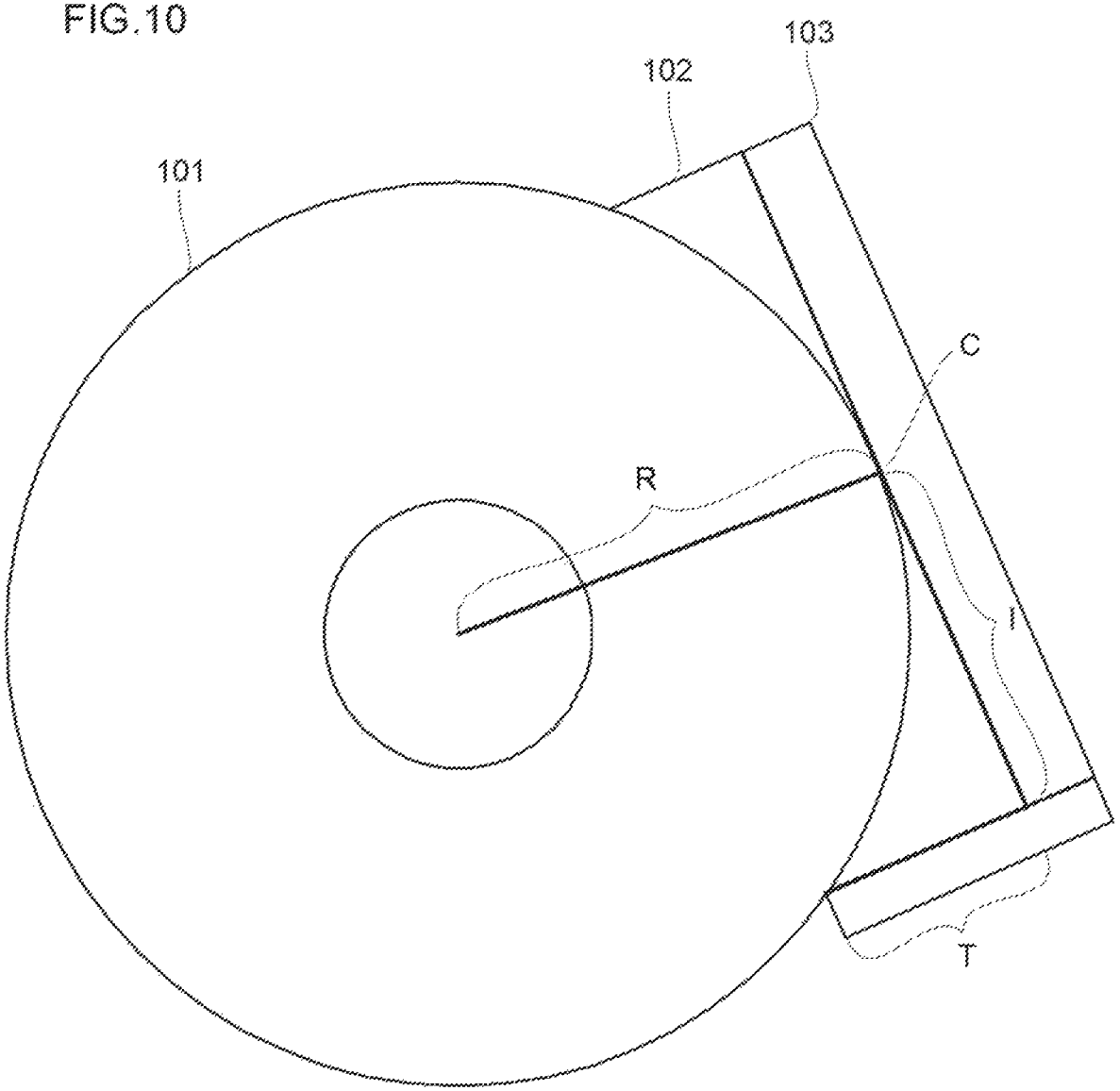
FIG. 10 is a schematic diagram of a lubricant application device adjacent a feeding roller, according to an example.

FIG. 10 is a schematic view to define the configuration of the end detection member 130. In FIG. 10, R denotes a radius when the feeding roller 101 comes in contact with the support member 103, 1 denotes a distance from a contact point C between the feeding roller 101 and the support member 103 of the lubricant source to the end detection member 130, and T denotes a distance from the support member 103 to an edge portion of the end detection member 130. The end detection member 130 can be configured to satisfy the following expression such that the end detection member 130 comes in contact with the feeding roller 101 before the lubricant is entirely exhausted (completely used up).

$$T>R-(R^2-I^2)^{1/2} \quad (1)$$

As shown in FIGS. 4A and 4B, the lubricant source 102 is fixed to the support member 103. In this case, the lubricant source 102 is in an initial state. The near-end detection member 110 is arranged so as to be rotatably supported through the pivot point 104 by the support member 103. The upper end surface 113 of the near-end detection member 110 abuts on the bottom surface 105*b* of the lower end portion 105 of the support member 103 and the engagement member 114 engages with the overhang portion 106 of the support member 103. Accordingly, the near-end detection member 110 is fixed to the support member 103 to prepare for the detection of the near-end of the lubricant source 102.

Continuous use of the image forming apparatus 1 gradually consumes the lubricant source 102. As the lubricant 102 is consumed, an edge portion of the extended portion 112 of the near-end detection member 110 gradually moves closer to the feeding roller 101 as indicated by arrow 170 in FIG. 5A. With reference to FIGS. 5A and 5B, a near-end state of the lubricant corresponds to a consumption of about 65% to about 85% of the lubricant source 102 in some examples, to about 70% to about 85% of the lubricant source 102 in other examples, or to about 80% of the lubricant source 102 in yet other examples. When the lubricant source 102 is consumed to reach the near-end state, the edge portion of the extended portion 112 of the near-end detection member 110 contacts the feeding roller 101, and the edge portion of the extended portion 112 contacts the feeding roller 101. For example, the edge portion of the extended portion 112 may gradually bite into the feeding roller 101. Consequently, the torque of the driving device to rotate and drive the feeding roller 101 is gradually increased. The state where the torque is increased is shown in FIG. 12.

Figure 12:
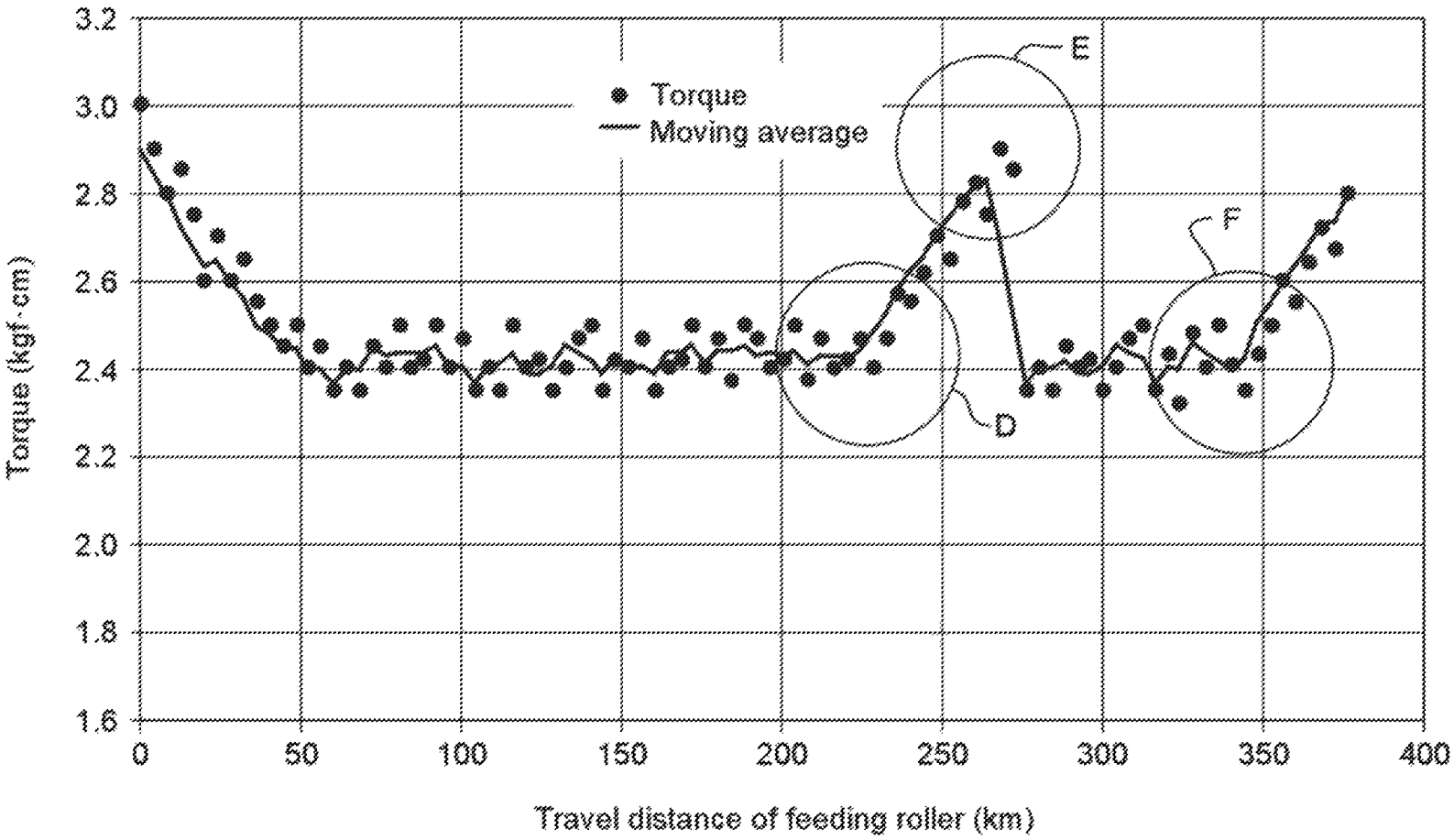
FIG. 12 is a graph of torque of a motor driving a feeding roller relative to a travel distance of the feeding roller.

FIG. 12 is a graph showing a relationship between the travel distance of the feeding roller 101 and the torque of the motor. When the travel distance is in the range of 0 to about 60 km, the torque decreases from about 3 kgf·cm to about 2.4 kgf·cm. This indicates that the lubricant is applied to the photosensitive drum 40 and the lubricant is gradually adhered to the cleaning blade 4 and the blade 5, thereby reducing friction to a lower level. Thereafter, the torque is stabilized at about 2.4 kgf·cm. As indicated by circle D in FIG. 12, the edge portion of the extended portion 112 of the near-end detection member 110 comes in contact with and gradually bites into the feeding roller 101, and this increases the torque gradually or moderately.

As described above, the torque detection means of the motor to rotate and drive the feeding roller 101, can output a torque signal expressing or representing a torque of the motor. The controller 70 of the image forming apparatus 1 can constantly monitor the torque signal. For example, the controller 70 can conduct sampling of a torque signal for each second to obtain a torque and can calculate a moving average in the section of 20 obtained torque values. When the torque gradually increases and exceeds a predetermined threshold, the controller 70 identifies that the lubricant source 102 is near an end (see circle E in FIG. 12), such that a near-end state of the lubricant source 102 is detected. In this case, the controller 70 can notify a user or the like through a monitor screen of the image forming apparatus 1 that the lubricant source 102 is near an end (the near-end state of the lubricant source 102). In addition, the image forming apparatus 1 may be configured to communicate with a service center or the like, to send a notice indicating that the lubricant source 102 is near an end, to the service center or the like.

With reference to FIGS. 6A and 6B, after the controller 70 detects the near-end of the lubricant source 102, it can control the driving device of the feeding roller 101 to reverse-rotate the feeding roller 101 along a rotational direction Rc. In the state where the edge portion of the extended portion 112 of the near-end detection member 110 bites into the feeding roller 101 (indicated by broken lines in FIGS. 6A and 6B), reverse-rotation of the feeding roller 101 can release the engagement (snap-fit) between the engagement member 114 and the overhang portion 106 of the support member 103. The near-end detection member 110 is rotated about the pivot point 104 as indicated by arrow Rd (FIG. 6B) by the release of the engagement, to move into a non-contact state with the feeding roller 101 (indicated by solid lines in FIGS. 6A and 6B). Thereafter, the controller 70 controls the driving device of the feeding roller 101 to positively rotate the feeding roller 101 along the ordinary rotational direction Rb. Since the near-end detection member 110 is not in contact with the feeding roller 101, the torque is decreased from the state indicated by the circle E in FIG. 12 to about 2.4 kgf·cm. However, in the case that the controller 70 cannot detect a decrease of torque when the feeding roller 101 is positively rotated after the reverse rotation of the feeding roller 101, the controller 70 can determine that the engagement between the engagement member 114 of the near-end detection member and the overhang portion 106 of the support member 103 is not released. In this case, the controller 70 can again reverse-rotate the feeding roller 101. Until the controller 70 can detect a decrease in torque, the controller may repeat the above-operations to attempt reverse rotation of the feeding roller 101. When the controller carries out several attempts which exceed a threshold number (for example, four times) without detecting a decrease of torque, a notice or indication of failure can be sent to a user, via a user interface device (e.g., a display screen) to stop an operation of the image forming apparatus 1.

Figure 9A:
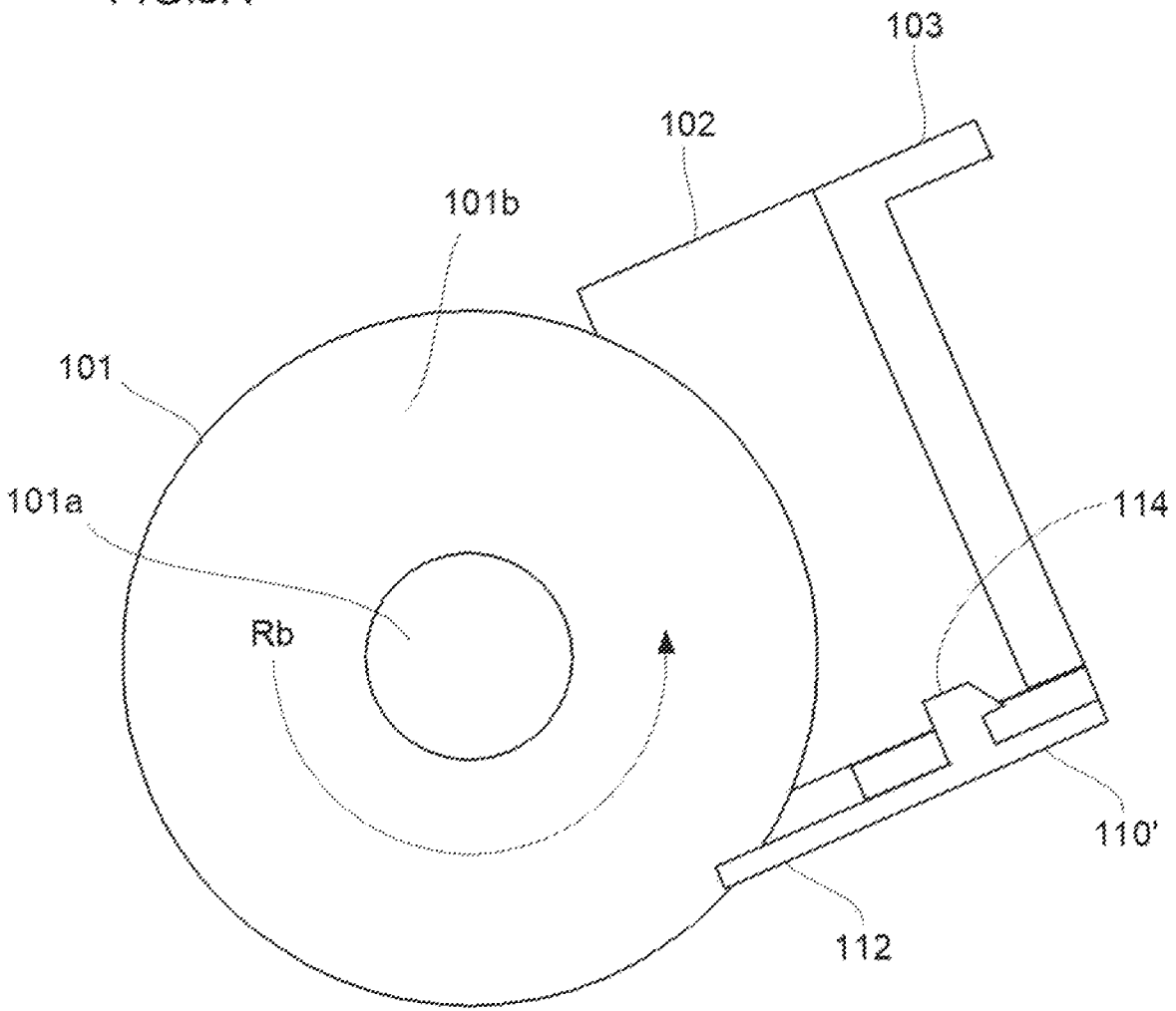
FIG. 9A is a schematic diagram, illustrating a side view of a lubricant application device adjacent a feeding roller, according to another example, shown in an operational state of detecting a near-end state of the lubricant.
Figure 9B:
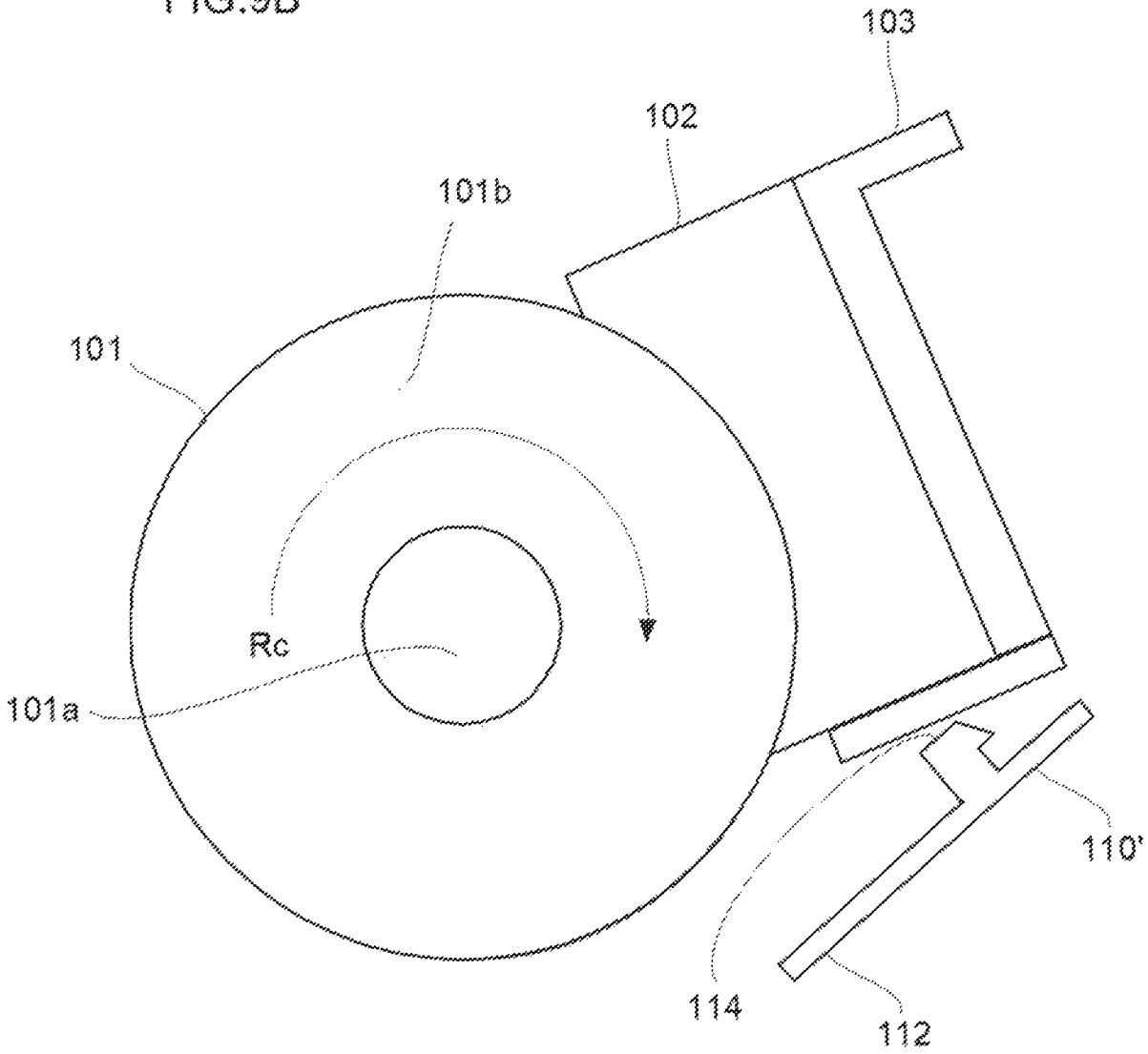
FIG. 9B is a schematic diagram of the lubricant application device of FIG. 9A, shown in an operational state after the near-end state of the lubricant has been detected.

The above-described near-end detection member 110 is rotatably supported by the support member 103 via the pivot point 104. In other examples, with reference to FIGS. 9A and 9B, the near-end detection member 110' can be fixed to the support member 103 using the engagement member 114 alone. FIG. 9A shows a state wherein the edge portion of the extended portion 112 of the near-end detection member 110' bites into the feeding roller 101. As shown in FIG. 9B, reverse rotation (Rc) of the feeding roller 101 releases the engagement (snap-fit) between the engagement member 114 and the overhang portion 106 of the support member 103, so that the near-end detection member 110' is removed and dropped from the support member 103. The dropped near-end detection member 110' can be received by a tray or the like so as not to negatively affect the operations of the image forming apparatus 1.

Figure 11A:
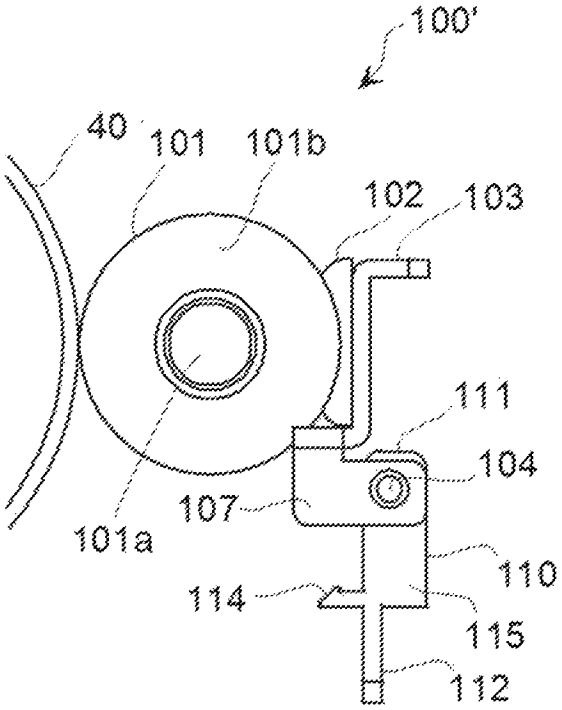
FIG. 11A is a schematic diagram, illustrating a side view of a lubricant application device and adjacent components according to an example, shown in an operational state of detecting a near-end state of the lubricant.
Figure 11B:
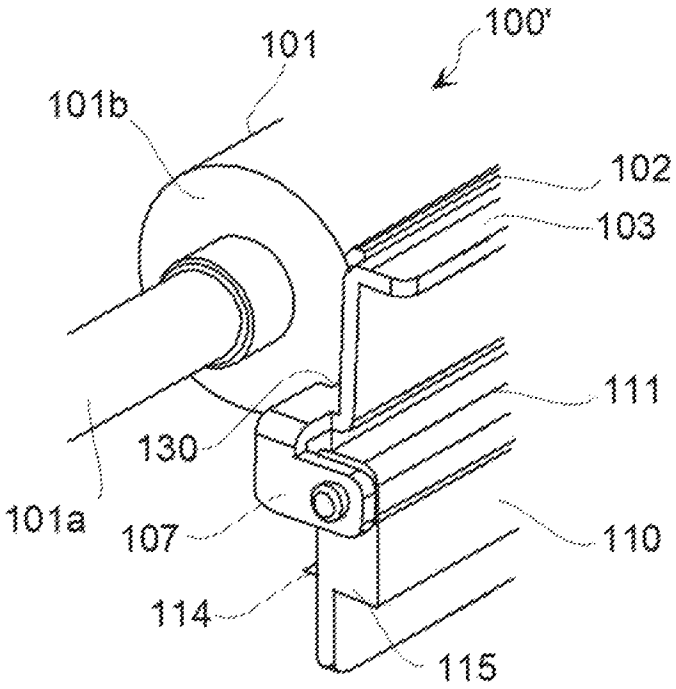
FIG. 11B is a schematic diagram, illustrating a perspective view of the lubricant application device of FIG. 11A.

Subsequently to the detection of the near-end state of the lubricant source 102, a continued operation of the image forming apparatus 1 further consumes the lubricant source 102. As the lubricant source 102 is gradually consumed, the end detection member 130 (lower end portion 105) of the support member 103 gradually moves closer to the lubricant source 102. According to examples, when about 90% to about 98% of the lubricant source 102, for example about 95% of the lubricant source 102, is consumed, an edge portion of the end detection member contacts the feeding roller 101, and subsequently, gradually bites into the feeding roller 101. Consequently, the torque of the driving device to rotate and drive the feeding roller 101, is gradually increased as indicated by circle F in FIG. 12. FIGS. 11A and 11B show a state where the end detection member 130 bites into the feeding roller 101 after consumption of a second amount of the solid lubricant source 102 and the end thereof is detected. Subsequently, when a gradually increasing torque exceeds a predetermined threshold, the controller 70 identifies that the lubricant source 102 is ended, so as to detect an end state of the lubricant source 102. In this case, the controller 70 can notify a user, or the like that the lubricant source 102 is substantially ended or exhausted via a user interface device such as a display screen (a monitor screen) of the image forming apparatus 1. In addition, the image forming apparatus 1 may be configured to communicate with a service center or the like, to send an indication that the lubricant source 102 is substantially ended or exhausted, to the service center or the like.

The controller 70 can monitor a travel distance of the feeding roller 101 or a travel distance of the photosensitive drum 40 during operations of the image forming apparatus 1. In the case that the controller 70 detects the near-end or the end a described above, the controller 70 can make a determination of the near-end state or end state of the lubricant source 102, taking into consideration a travel distance of the feeding roller 101 or the photosensitive drum 40. For example, when the controller 70 detects the near-end state or the end state of the lubricant source 102, the controller 70 can also determine whether or not the travel distance exceeds a threshold. When the travel distance exceeds the threshold, the controller 70 can determine that the lubricant source is near an end (nearly exhausted) or ended (substantially exhausted). When the threshold is not exceeded, the controller 70 can determine that the detection is erroneous, so as to improve the accuracy in detecting the near-end state or the end state of the lubricant source 102.

Figure 13A:
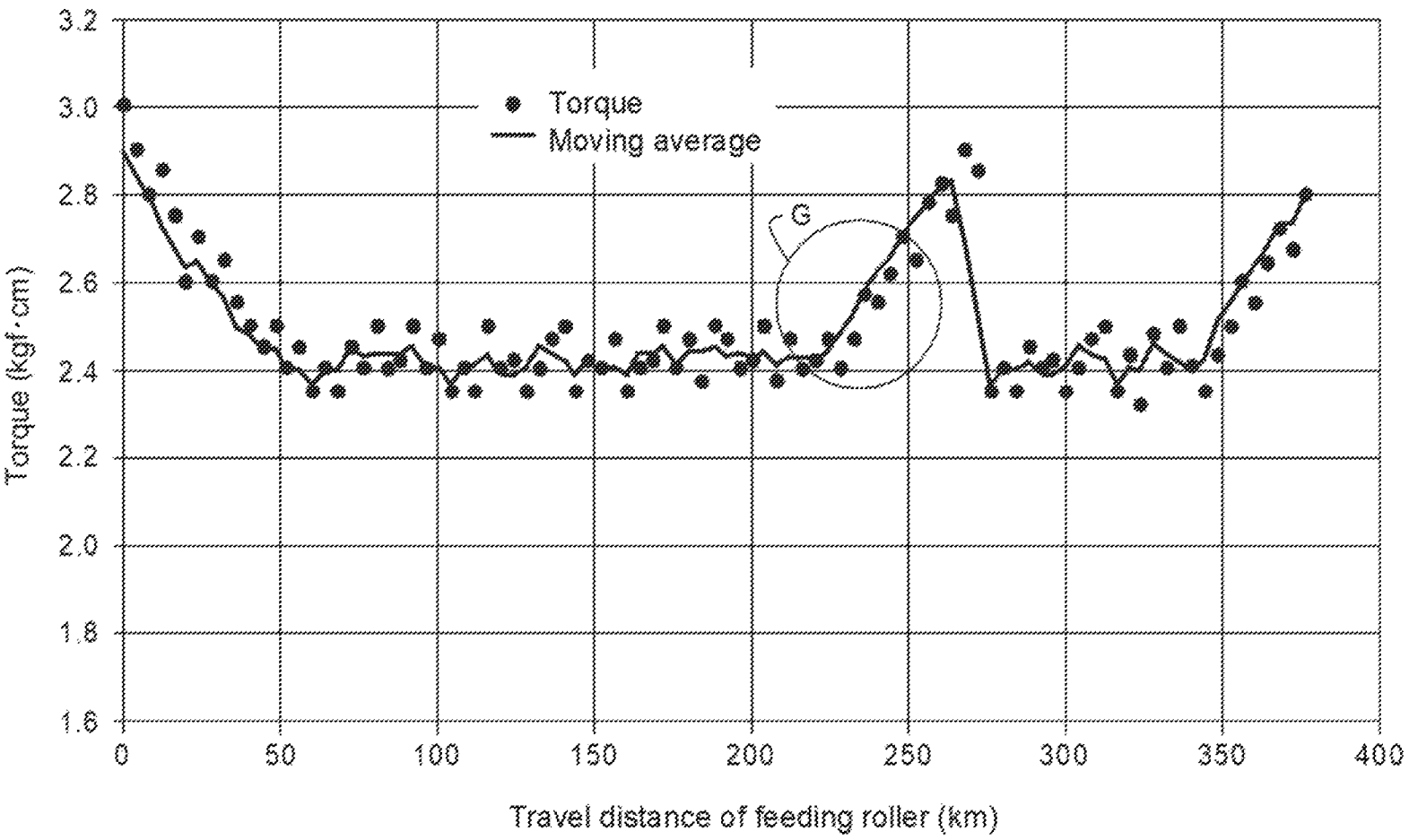
FIG. 13A is a graph of torque of a motor driving a feeding roller, relative to a travel distance of the feeding roller, during an example operation of an image forming apparatus.
Figure 13B:
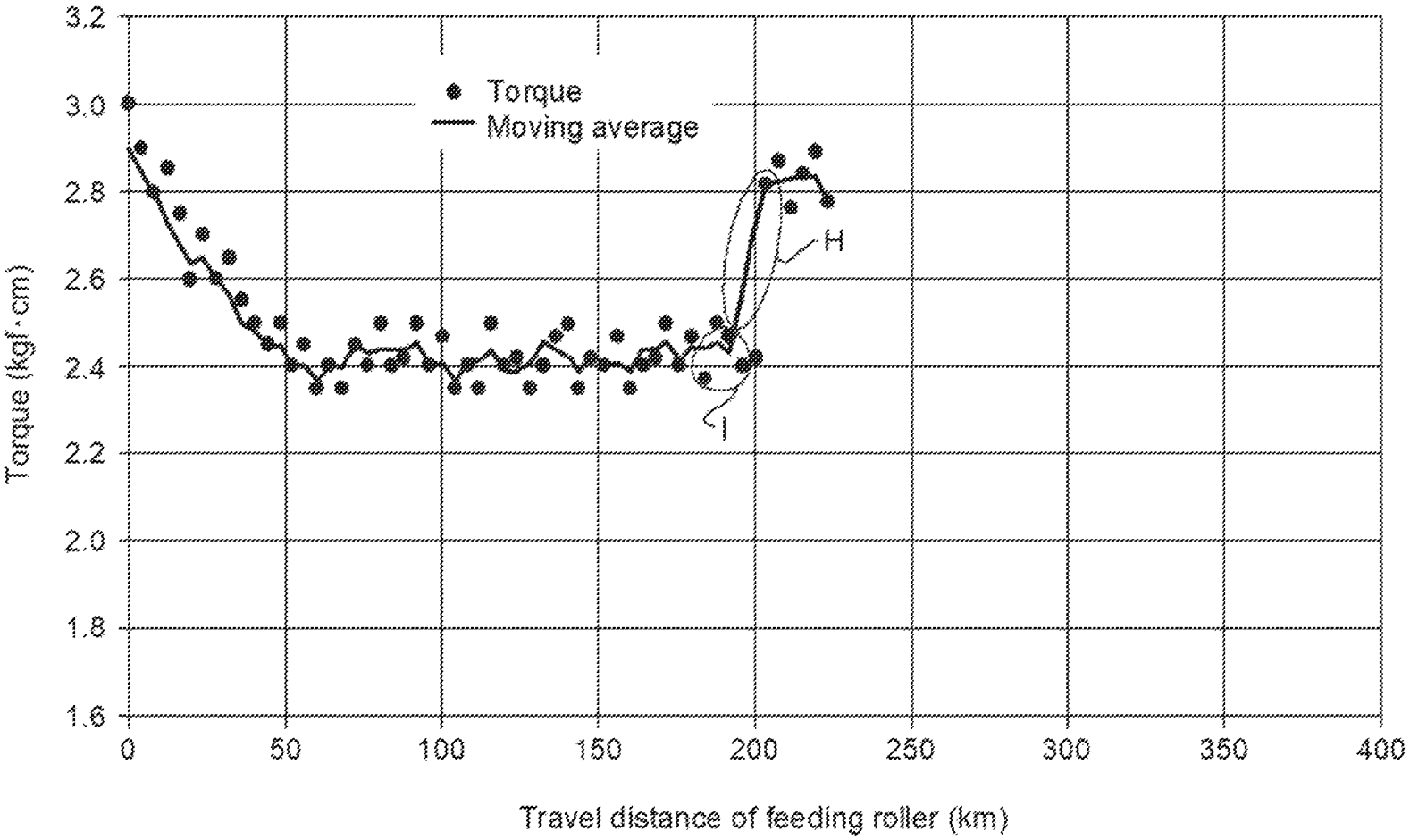
FIG. 13B is a graph of torque of the motor driving, relative to the travel distance of the feeding roller, during another example operation of the image forming apparatus.

FIG. 13A is a graph showing a relationship between a travel distance of the feeding roller and torque, showing an example of torque increase during normal time. FIG. 13B shows an example of torque increase caused by a failure. During operations of the image forming apparatus 1, the cleaning blade 4 formed of an elastic body may at times curl (become curled up) against the rotation of the rotation of the photosensitive drum 40, imparting a large load on the rotation of the photosensitive drum 40. When the feeding roller 101 is rotated and driven by power from the motor that drives the photosensitive drum 40 into rotation, an abrupt torque increase may be detected as indicated by circle H in FIG. 13B.

As described above, the controller 70 can conduct sampling of a torque signal, for example at every second, to obtain a torque, and can calculate a moving average among a number of torque value obtained, for example 20 torque values measured. In some examples, the controller 70 can calculate a gradient of torque relative to the travel distance of the feeding roller. For example, the controller 70 can calculate a gradient of torque by dividing an average value of 20 torque values (excluding a value at a point of measurement) taken just before the point of measurement, by a 20-second travel distance of the feeding roller. The controller 70 can iteratively recalculate this gradient. For example, as indicated by circle G in FIG. 13A, the gradient at the time when the torque is increased during normal time becomes about 0.0085, which is experimentally obtained. When the controller 70 detects the near-end or the end of the lubricant source 102, the controller 70 can make a determination by considering this gradient. In this example, the threshold for the gradient can be set to, for example, 0.004. When the controller 70 detects the near-end state or the end state of the lubricant source 102 as described above, it can further determine whether or not the gradient exceeds this threshold. When the gradient exceeds the threshold, the controller 70 can determine that the detection of the near-end state or the end state is normal (e.g., a correct determination).

The controller 70 can take into consideration an abrupt torque increase as indicated by circle H in FIG. 13B in addition to taking into consideration a gradient as described above, to determine the detection of the near-end state and/or the end state of the lubricant source 102. The controller 70 can calculate the above gradient, and simultaneously, can iteratively recalculate and maintain an average of torques measured in the latest 20 seconds. When this average has a value that is equal to or more than a predetermined value, it can be determined that the torque is abruptly increased as indicated by circle H in FIG. 13B, For example, in FIG. 13B, an experimentally calculated average of torques for the latest 20 seconds (portion of circle I) is about 2.42 kgf·cm. Then, the controller 70 sets a threshold width to, for example, 0.2 kgf·cm, and sets a value of 2.62 kgf·cm in advance as a threshold for determination. When the torque increases abruptly as indicated by circle H in FIG. 13B, the average of torques exceeds the threshold of 2.62 kgf·cm, and the controller 70 can identify an abrupt torque increase and determine that the detection of the near-end state and/or the end state of the lubricant source 102, is erroneous, and further determine that an operation of the image forming apparatus 1 is abnormal (e.g., out of order).

According to examples, a lubricant application device includes a near-end detection member and an end detection member mounted to a support member of an existing lubricant application device and monitors a torque signal from an existing motor, to more precisely detect a near-end state and/or an end state of a lubricant. Accordingly, the example lubricant application device may detect a remaining amount or the like of the lubricant in a low-cost and space-saving manner, as compared with a continuity detection method carried out with a mechanical mechanism, an electric sensing circuit or the like, or as compared with a detection method by use of an optical sensor. In addition, the example lubricant application device may detect both of the near-end state and the end state of the lubricant, to optimize a replacement timing of a lubricant source or of a lubricant application device or of a unit including a lubricant application device. For example, the replacement timing may be associated with a state where the lubricant is almost used up (before the lubricant is entirely or substantially exhausted).

It is to be understood that not all aspects, advantages and features described herein may necessarily be achieved by, or included in, any one particular example, Indeed, having described and illustrated various examples herein, it should be apparent that other examples may be modified in arrangement and detail is omitted.

The invention claimed is:

1. A lubricant application device, comprising:

a rotatable applicator to apply a lubricant from a solid lubricant source to a rotating member;

a support member to support the solid lubricant source in contact with the rotatable applicator;

a near-end detection member coupled to the support member to directly contact the rotatable applicator after a first amount of the solid lubricant source has been consumed; and an end detection member coupled to the support member to directly contact the rotatable applicator after a second amount of the solid lubricant source has been consumed, wherein the near-end detection member is to increase a torque of a motor driving the rotatable applicator based on the near-end detection member contacting the rotatable applicator and the near-end detection member is to be released from contact with the rotatable applicator in response to an increase of the torque of the motor, and wherein the rotatable applicator is rotatable in a reverse direction to release the near-end detection member from contact with the rotatable applicator.

2. The lubricant application device of claim 1, the end detection member to increase the torque of the motor when the end detection member contacts the rotatable applicator.

3. The lubricant application device of claim 1, wherein the motor includes a torque detector to detect the increase of the torque.

4. The lubricant application device of claim 1, wherein the near-end detection member comprises a base portion, an extended portion extending from the base portion toward the rotatable applicator, an upper end surface formed on the base portion and the extended portion, and an engagement member protruding from the upper end surface, and wherein the support member has a lower end portion and an overhang portion extending from the lower end portion, the upper end surface of the near-end detection member to abut with the lower end portion of the support member and the engagement member to engage with the overhang portion of the support member, when the near-end detection member comes in contact with the rotatable applicator.

5. The lubricant application device of claim 4, wherein the rotatable applicator is rotatable in the reverse direction to release the engagement member from the overhang portion, in order to release the near-end detection member from contact with the rotatable applicator.

6. The lubricant application device of claim 5, wherein the base portion of the near-end detection member includes a side portion having a pivot that is rotatably supported by the support member, the near-end detection member to rotate about the pivot when the engagement member is released, to move the extended portion of the near-end detection member to be spaced away from the rotatable applicator.

7. The lubricant application device of claim 1, wherein the end detection member is included as part of the support member.

8. An image forming apparatus comprising:

a lubricant application device, wherein the lubricant application device comprises:

a rotatable applicator to apply a lubricant from a solid lubricant source to a photosensitive drum;

a support member to support the solid lubricant source in contact with the rotatable applicator;

a near-end detection member coupled to the support member to directly contact the rotatable applicator after a first amount of the solid lubricant source has been consumed; and an end detection member coupled to the support member to directly contact the rotatable applicator after a second amount of the solid lubricant source has been consumed, wherein the near-end detection member is to increase a torque of a motor driving the rotatable applicator based on the near-end detection member contacting the rotatable applicator and the near-end detection member is to be released from contact with the rotatable applicator in response to an increase of the torque of the motor, and wherein the rotatable applicator is rotatable in a reverse direction to release the near-end detection member from contact with the rotatable applicator.

9. The image forming apparatus of claim 8, the end detection member to increase the torque of the motor when the end detection member contacts the rotatable applicator.

10. The image forming apparatus of claim 9 comprising a controller to:

monitor the torque of the motor;

detect a near-end state of the solid lubricant source when the near-end detection member contacts the rotatable applicator to increase the torque of the motor; and detect an end state of the solid lubricant source when the end detection member contacts the rotatable applicator to increase the torque of the motor.

11. The image forming apparatus of claim 10, the controller to:

monitor a distance by which a surface of the photosensitive drum has moved;

detect at least one of the near-end state and the end state of the solid lubricant source, when the distance exceeds a predetermined value.

12. The image forming apparatus of claim 10, the controller to:

detect an increase in the torque of the motor that is associated with a rate of increase; and determine an erroneous detection when the rate of increase exceeds a threshold rate.

13. The image forming apparatus of claim 8, wherein the near-end detection member comprises a base portion, an extended portion extending from the base portion toward the rotatable applicator, an upper end surface formed on the base portion and the extended portion, and an engagement member protruding from the upper end surface, and wherein the support member has a lower end portion and an overhang portion extending from the lower end portion, the upper end surface of the near-end detection member to abut with the lower end portion of the support member and the engagement member to engage with the overhang portion of the support member, when the near-end detection member comes in contact with the rotatable applicator.

14. The image forming apparatus of claim 13, wherein the rotatable applicator is rotatable in the reverse direction to release the engagement member from the overhang portion, in order to release the near-end detection member from contact with the rotatable applicator.

15. The image forming apparatus of claim 14, wherein the base portion of the near-end detection member includes a side portion having a pivot that is rotatably supported by the support member, the near-end detection member to rotate about the pivot when the engagement member is released, to move the extended portion of the near-end detection member to be spaced away from the rotatable applicator.

16. The image forming apparatus of claim 8, wherein the end detection member is included as part of the support member.

* * * * *